United States Patent [19]

Susa et al.

[11] Patent Number: 4,809,773

[45] Date of Patent: Mar. 7, 1989

[54] AUTOMOTIVE RADIATOR

[75] Inventors: Sumio Susa, Anjo; Toshio Nagara, Toyota; Sunao Fukuda, Oobu; Seiichi Kato, Toyoake; Satomi Muto, Nagoya, all of Japan

[73] Assignee: Nippondenso Co., Ltd., Kariya, Japan

[21] Appl. No.: 17,075

[22] Filed: Feb. 20, 1987

[30] Foreign Application Priority Data

Feb. 20, 1986 [JP] Japan ..... 61-35564
Dec. 3, 1986 [JP] Japan ..... 61-288355

[51] Int. Cl.[4] ..... F01P 11/02

[52] U.S. Cl. ..... 165/104.32; 123/41.51; 123/41.54

[58] Field of Search ..... 165/104.32; 123/41.51, 123/41.54

[56] References Cited

U.S. PATENT DOCUMENTS 3,265,048 8/1966 Herbon .
3,809,150 5/1974 Holmes ..... 123/41.54
4,358,051 11/1982 Hunt ..... 123/41.54
4,492,267 1/1985 Cadars ..... 123/41.54

FOREIGN PATENT DOCUMENTS 41391 3/1980 Japan .

*Primary Examiner*—Albert W. Davis, Jr.
*Attorney, Agent, or Firm*—Cushman, Darby & Cushman

[57] ABSTRACT

A radiator for an automotive engine has a filler neck having a coolant pass therein. The filler neck has both an inner tubular member and an outer tubular member so that the coolant pass is formed between the inner surface of the outer tubular member and the outer surface of the inner tubular member. The coolant pass is connected with a connecting pipe in order to introduce the coolant within the coolant pass toward the connecting pipe. The coolant introduced into the connecting pipe is, then, flows toward a reserve tank.

Since all coolant flowing toward the connecting pipe is orientated its vector while passing through the coolant pass, the coolant can be introduced into the connecting pipe smoothly.

12 Claims, 6 Drawing Sheets

AUTOMOTIVE RADIATOR

FIELD OF THE INVENTION

The present invention relates to an automotive radiator, especially relates to a structure of a filler neck.

BACKGROUND OF THE INVENTION

A conventional automotive radiator has a tubular member which is connected to a filler neck formed on an upper tank, as shown in Japanese patent laid-open publication (KOKAI) No. 55-41391, a radiator cap which has both negative pressure valve and a pressure valve connected to the tubular member and a connecting pipe connected with the tubular member so that the tubular member is connected with a reserve tank through the connecting pipe.

The pressure valve of the radiator cap opens in order to release super heated steam within the upper tank to the reserve tank when the pressure within the upper tank increases up to the predetermined pressure.

Such automotive radiator described above has a technical disadvantage. Namely, the super heated steam within the upper tank floods out from an annular sealing portion of the pressure valve toward whole orientations when the pressure valve is opened. The stream of flooded super heated steam, therefore, must be scrolling flow having the whole vectors. Since the connecting pipe is opened at only one point of the side wall of the tubular member, it must be very hard for such scrolling super heated steam flow to be introduced in the connecting pipe and to flow toward the reserve tank. The scrolling super heated steam flow should be remain within the tubular member so that the pressure within the tubular member must increase and it causes serious influence to the predetermined opening pressure of the pressure valve.

SUMMARY OF THE INVENTION

The object of the present invention is to cease the above described technical disadvantages. Further object of the present invention is to release the super heated steam within an upper tank to a reserve tank through a connecting pipe when a pressure valve opens a filler neck. In order to attain the above objects, the present invention has an inner tubular member connected to the filler neck and an outer tubular member connected to the inner tubular member so that a coolant pass is formed between the inner tubular member and the outer tubular member. The connecting pipe is connected to the outer tubular member so that the coolant pass is connected with the reserve tank through the connecting pipe.

The super heated steam flooded from the pressure valve is controlled its flow vector by flowing within the coolant pass. The super heated steam can be introduced into the connecting pipe after the flow vector of which is controlled to be oriented.

Since the super heated steam flow flooded from the pressure valve is controlled its vector by the coolant pass in order to orient toward the connecting pipe, the super heated steam can be introduced to the reserve tank smoothly. So that the super heated steam can be released toward the reserve tank without increasing the pressure within both the inner tubular member and the outer tubular member so that the predetermined opening pressure of the pressure valve can be maintained.

PREFERRED EMBODIMENTS

Figure 5:
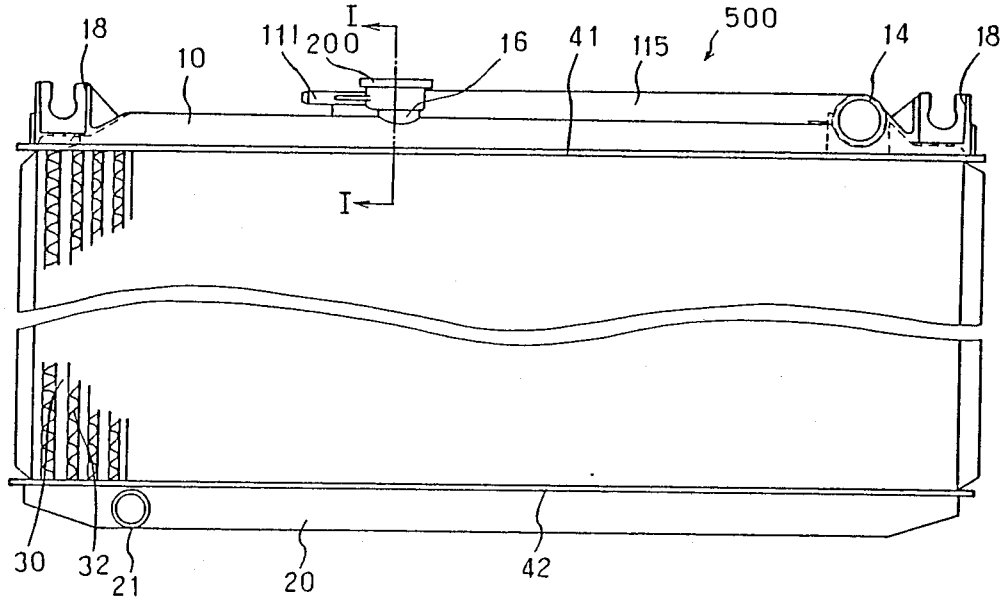
FIG. 5 is a front view showing an automotive radiator according to the first embodiment of the present invention.

The preferred embodiment of the present invention is described hereinafter. FIG. 5 is a front view showing an automotive radiator 500. An inlet port 14 through which an engine coolant heated within an automotive engine is introduced is provided at an upper tank 10 which is made of resin. The inlet port 14 has a predetermined inner diameter in order be to connected with a pipe through which the coolant from the engine flows. The upper tank 10 has a filler neck 16 at an upper side thereof, with and a cap 200 is detachably connected with the filler neck 16. The upper tank 10 also has brackets 18 at upper and side corner thereof. The automotive radiator 500 is fixed with an automotive body via the brackets 18. One end of a plurality of tubes 30 is connected with the upper tank 10 and another end of tubes 30 is connected with a lower tank which is made of resin. Corrugated fins 32 are provided between the tubes 30. The lower tank 20 has an outlet port through which the coolant within the lower tank 20 flows toward the engine. Numerals 41 and 42 show caulking plates.

An inner tubular member is connected with the filler neck 16 and the outer tubular member is also connected with the inner tubular member. The cap 200 is detachably fitted with the outer tubular member. The connecting pipe 111 is connected with the outer tubular member.

Figure 1:
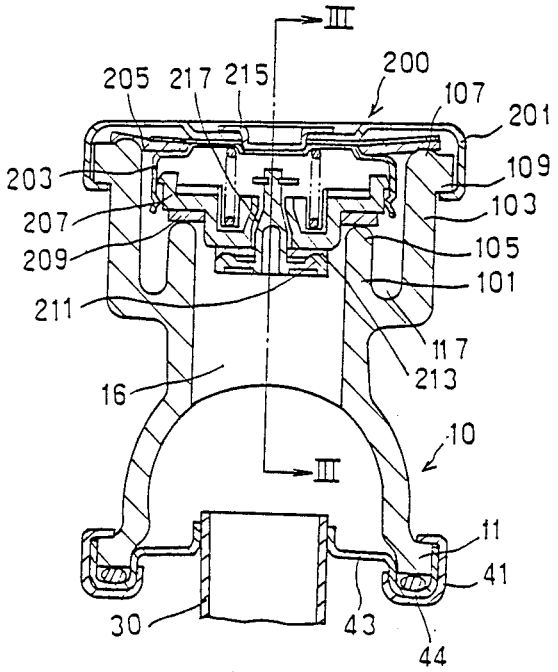
FIG. 1 is a sectional view showing the first embodiment of the present invention and showing the section taken along with I—I line of FIG. 5.
Figure 2:
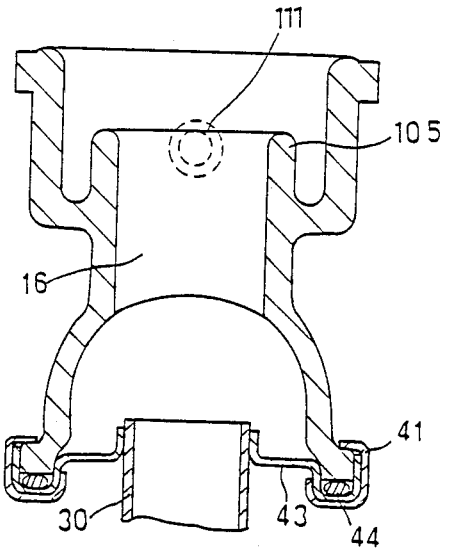
FIG. 2 is a sectional view showing the same structure shown in FIG. 1 but the cap is deleted.

The structure around the filler neck is described hereinafter. FIG. 1 is a sectional view taken along with I—I line of FIG. 5, FIG. 2 is a sectional view showing the same structure shown in FIG. 1 but the cap 200 is deleted. The opening edge 11 of the upper tank 20 is inserted within a groove formed in a core plate 43 via an O-ring. The caulking plate 41 is caulked in such a manner that the caulking plate 41 wraps both the core plate 43 and the opening edge 11 so that the upper tank 10 and the core plate 43 are fixed. A plurality of tubes 30 are connected with the core plate 43 by welding.

The inner tubular member 101 connected to the filler neck 16 elongates upwardly so that the upper most edge of the inner tubular member 101 forms an inner seal portion.

One edge of the outer tubular member 103 is connected with the outer wall surface of the inner tubular member 201 at an inter-mediate portion of the inner tubular member 101. The outer tubular member 103 also elongates upwardly so that the upper most edge of the outer tubular member 103 forms an outer seal portion 107. A flange 109 to which an outer cap member 201 of the cap 200 is hooked is formed at the upper most edge of the outer tubular member 103.

The inner diameter of the outer tubular member 103 is larger than the outer diameter of the inner tubular member 101 by the predetermined amount. According to the preferred embodiment, the inner diameter of the outer tubular member 103 is 31 mm and the outer diameter of the inner tubular member 101 is 24 mm. So that an annular coolant pass 117 the width of which is 3.5 mm is formed between an outer wall surface of the inner tubular member 101 and an inner wall surface of the outer tubular member 103. The outer seal portion 107 of the outer tubular member 103 is located upper than the inner seal portion 105 of the inner tubular member 101. The connecting pipe 111 is connected with the outer tubular member 103 so that the annular coolant pass 111 is connected with the reserve tank through the connecting pipe 111.

According to the preferred embodiment, the upper most edge of the connecting pipe 111 locates almost same position with the inner seal portion 105 and the lower most edge of the connecting pipe 111 locates slightly upper than the position of the bottom of the annular coolant pass 117.

The cap 200 has a sealing member 205 which is scissored with the outer cap member 201 and an inner cap member 203. The sealing member 205 is sit on the outer seal portion 107 for sealing the outer seal portion 107 when the outer cap member 201 is hooked on the flange portion 109. The cap 200 also has the pressure valve 207 which has a sealing member 209 for sealing the inner seal portion 105. The sealing member 209 is biased toward the inner seal portion 105 by a spring which is provided between the pressure valve 207 and the inner cap member 203. A negative pressure valve 211 is provided within the pressure valve 207, and the negative pressure valve 211 also has sealing member 213. Though at the condition shown in FIG. 1 the sealing member 213 of the negative pressure valve 211 is contacted with the pressure valve 207, the sealing member 213 is detached from the pressure valve 207 for connecting the atmosphere within the upper tank 10 with the space formed upper side of the pressure valve 207 when the pressure within the upper tank 10 reduces below air pressure.

Figure 3:
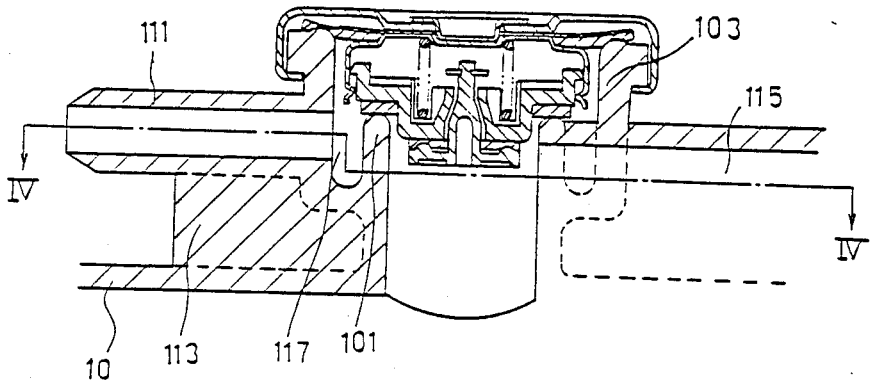
FIG. 3 is a sectional view taken along with III—III line of FIG. 1.

FIG. 3 is a sectional view taken along with the line III—III of FIG. 1. As shown in this FIG. 3, one end of the connecting pipe 111 opens for confronting to the annular coolant pass 117, and the connecting pipe 111 elongates along with the longitudinal axis of the upper tank 10. Since the inner diameter of the inlet port 114 is larger than the height of the upper tank 10, an air leak pass 115 is formed between the upper portion of the inlet port 14 and the inner tubular member 101 so that the air built up stacked at the upper portion of the inlet port 14 can escape to the inner tubular member 101. The sectional shape of the air leak pass 115 is semicircular, and the air leak pass 115 is formed at an upper portion of the upper tank 10 in such a manner that the air leak pass 115 opens to the inner portion of the upper tank 10.

A supporting member 113 is formed between the connecting pipe 111 and the upper tank 10 and the supporting member elongates from one edge of the connecting pipe 111 to an intermediate portion of the connecting pipe 111.

Figure 4:
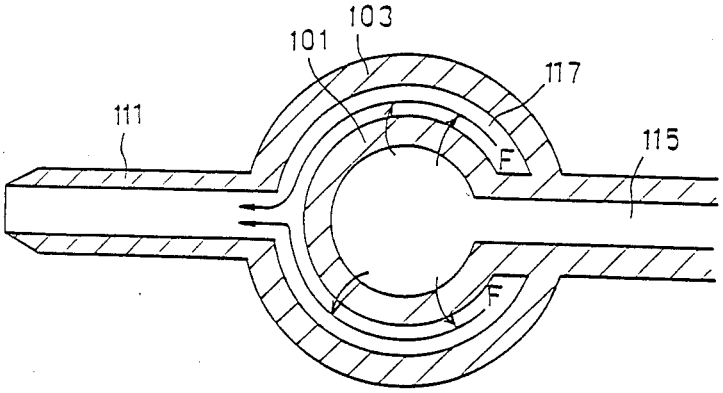
FIG. 4 is a sectional view taken along with IV—IV line of FIG. 3.

FIG. 4 is a sectional view taken along with IV—IV line of FIG. 3. As clearly shown from this FIG. 4, the annular coolant pass 117 is formed between the inner tubular member 101 and the outer tubular member 103, and the connecting pipe 111 confronts to the annular coolant pass 117. The air leak pass 115 is formed at the opposite side of the connecting pipe 111. The annular coolant pass 117 is substantially "C" shaped.

Sealing member 209 of the pressure valve is lifted from the inner seal portion 105 against the biasing force of the spring 215 when the pressure in the upper tank 10 is increased up to the predetermined pressure value, so that the super heated steam within the upper tank 10 floods toward the annular coolant pass 117 through the portion between the inner seal portion 105 and seal member 209. Since almost every super heated steam flows toward the annular coolant pass 117, the flow of the super heated steam is orientated toward the annular coolant pass 117. Namely, every super heated steam flows toward the annular coolant pass 117 and then turn to its orientation along with the pass 117 as shown by arrow F in FIG. 4 toward the connecting pipe 111. The super heated steam introduced into the connecting pipe 111 then flows toward the reserve tank. It should be noted that since the every super heated steam flows along with the annular coolant pass 117, the flow of the super heated steam is orientated toward the connecting pipe 111 so that the super heated steam can be introduced into the connecting pipe 111 smoothly.

The sealing member 213 for negative pressure valve opens a pass 217 formed in the pressure valve 207 so that the inner space of the upper tank 100 is connected with the space upside of the pressure valve 207 through the pass 217 when the pressure within the upper tank 100 decreases below air pressure. Therefore, the coolant within the reserve tank returns toward the upper tank 10 through the connecting pipe 111 and the pass 217.

The air at the upper portion of the inlet port 14 which is introduced when the coolant is poured from the filler neck 16 is leaked into the inner tubular member 101 through the air leak pass 115.

The second embodiment of the present invention is described hereinafter.

Figure 6:
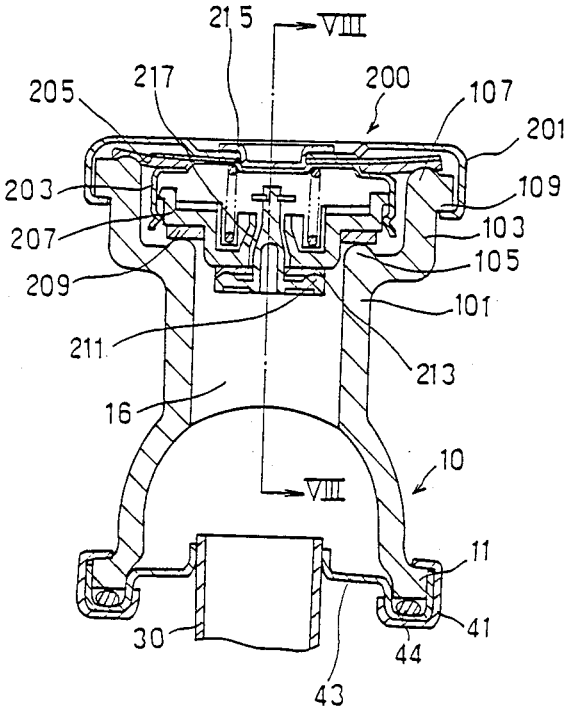
FIG. 6 is a sectional view showing the second embodiment of the present invention and showing the sectional shape taken along with VI—VI line of FIG. 10.
Figure 7:
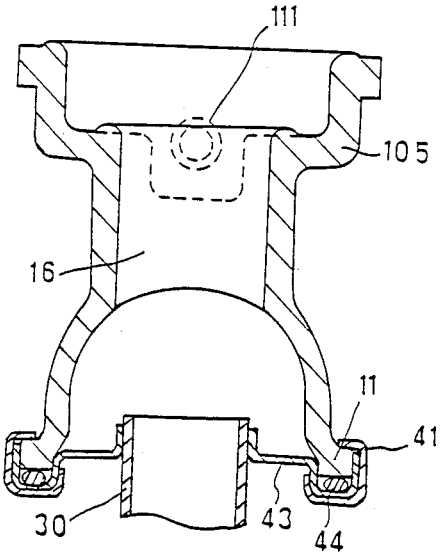
FIG. 7 is a sectional view showing the same structure as FIG. 6 but the cap is deleted.
Figure 8:
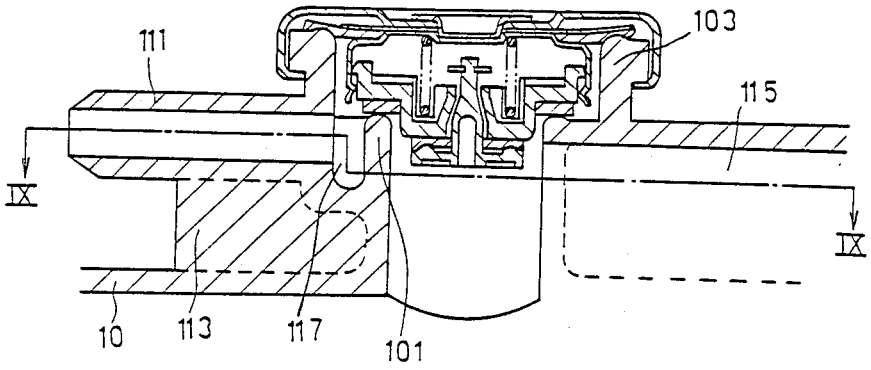
FIG. 8 is a sectional view taken along with VIII—VIII line of FIG. 6.
Figure 9:
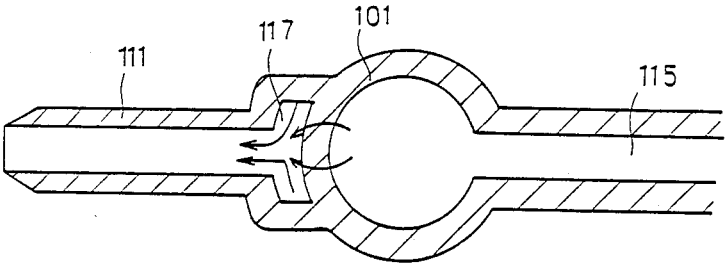
FIG. 9 is a sectional view taken along with IX—IX line of FIG. 8.
Figure 10:
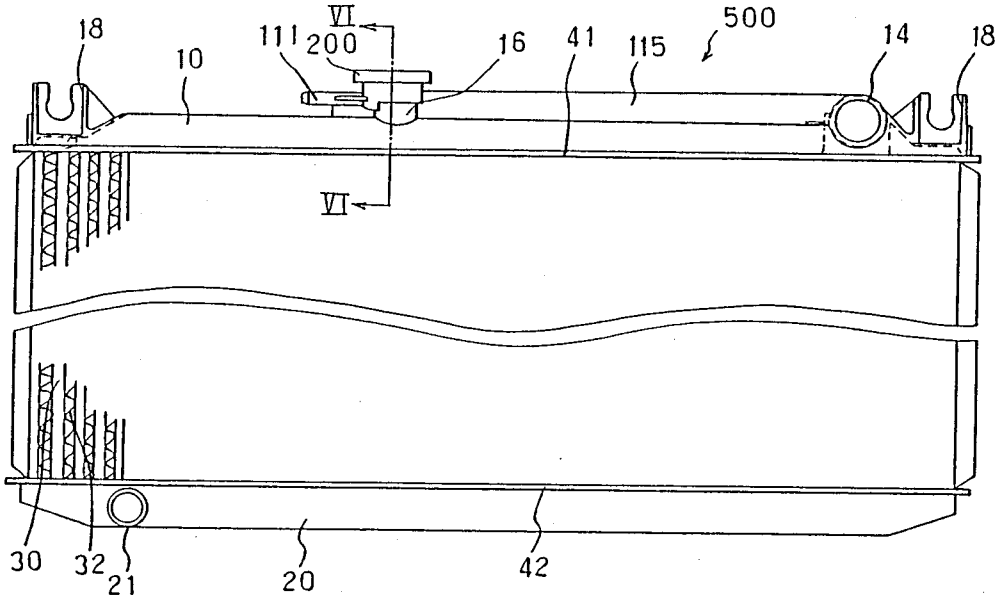
FIG. 10 is a front view showing an automotive radiator according to the second embodiment of the present invention.

The outer tubular member 103 of the second embodiment is connected to the inner tubular member 101 at near the upper end portion of the inner tubular member 101 as shown in FIG. 6, and the coolant pass 117 formed between the outer wall surface of the inner tubular member 101 is provided only around the opening portion of the connecting pipe 111, as shown in FIGS. 7–10.

The super heated steam within the upper tank 10 flows toward the coolant pass 117 through the inner seal portion 105 when the pressure valve 207 opens, so that the flow of the super heated steam is also orientated toward the coolant pass 117. Therefore the super heated steam can flow toward the reserve tank smoothly.

Other portions of the second embodiment are the same as those of the first embodiment, and the elements of the second embodiment are, therefore, numbered as the same numeral of those of the first embodiment.

What is claimed are:

1. An automotive radiator comprising:

an upper tank to which coolant from an automotive engine flows, said upper tank having an upper end and a lower end;

a tube coupled to said upper tank so that the coolant within said upper tank flows through said tube;

a lower tank coupled to said tube so that the coolant flowing said tube is introduced into said lower tank;

a filler neck mounted to said upper tank and opening upwardly relative to said upper end of said upper tank;

a tubular member provided around said filler neck, said tubular member having an outer seal portion opening upwardly relative to said filler neck upward opening and an inner seal portion opening upwardly relative to said filler neck upward opening and terminating at a height lower than said outer seal portion;

a cap detachably coupled to said tubular member, sitting on said inner seal portion and opening said inner seal portion when the pressure within said upper tank increases up to a predetermined pressure;

a connecting pipe one end of which is coupled to said tubular member at a portion which is lower than a portion of said inner seal portion, another end of said connecting pipe being coupled to a reverse tank having the coolant therein; and a coolant pass connecting said one end of said connecting pipe with a space defined above said inner seal portion.

2. An automotive radiator claimed in claim 1, wherein;

said tubular member comprises an inner tubular member one end of which is connected with said filler neck and another end of which opens to upwardly for forming said inner seal portion and an outer tubular member one end of which is connected with an outer side wall of said inner tubular member and another end of which opens upwardly for forming said outer seal portion.

3. An automotive radiator claimed in claim 2, wherein;

said coolant pass is formed between the outer wall surface of said inner tubular member and an inner wall surface of said outer tubular member so that said coolant pass is formed around said inner tubular member.

4. An automotive radiator claimed in claim 1, wherein;

said coolant pass is formed only around the one end of said connecting pipe.

5. An automotive radiator claimed in claim 1 wherein;

said upper tank and said lower tank is made of resin.

6. An automotive radiator claimed in claim 1, wherein;

said cap as a negative pressure valve which connects an inner side of said upper tank with said connecting pipe when a pressure within said upper tank decreases below predetermined pressure.

7. An automotive radiator comprising:

an upper tank to which coolant from an automotive engine is introduced said upper tank having an upper end and a lower end;

a tube coupled to said upper tank so that the coolant within said upper tank flows through said tube;

a lower tank coupled to said tube so that the coolant in said tube flows toward said lower tank;

a filler neck mounted to an upper surface of said upper end of said upper tank;

a tubular member provided around said filler neck and having an outer seal portion opening upwardly relative to said upper end of said upper tank and an inner seal portion opening upwardly relative to said upper end of said upper tank and terminating at a height lower than said outer seal portion;

a cap detachably connected with said tubular member, said cap having a pressure valve sitting on said inner seal portion and opening said inner seal portion when a pressure within said open tank increases up to a predetermined pressure and a spring biasing said pressure valve toward said inner seal portion, said spring contacting with said pressure valve at a portion lower than a portion of said inner seal portion;

a connecting pipe one end of which is connected with said tubular member at a portion which is lower than the portion of said inner seal portion and another end of which is connected with a reserve tank in which the coolant is stored; and a coolant pass connecting said connecting pipe with the space defined above said inner seal portion.

8. An automotive radiator claimed in claim 7, wherein;

said tubular member comprising an inner tubular member one end of which is connected with said filler neck and another end of which opens to upwardly for forming said inner seal member and an outer tubular member one end of which is connected with an outer side wall of said inner tubular portion and another end of which opens upwardly for forming said outer seal portion.

9. An automotive radiator claimed in claim 8, wherein;

said coolant pass is formed between the outer wall surface of said inner tubular member and an inner wall surface of said outer tubular member so that said coolant pass is formed around said inner tubular member.

10. An automotive radiator claimed in claim 7, wherein;

said coolant pass is formed only around the one end of said connecting pipe.

11. An automotive radiator claimed in claim 7 wherein;

said upper tank and said lower tank is made of resin.

12. An automotive radiator claimed in claim 7, wherein;

said cap has a negative pressure valve which connects an inner side of said upper tank with said connecting pipe when a pressure within said upper tank decreases below a predetermined pressure.

* * * * *